US008028688B2

(12) United States Patent
Karau et al.

(10) Patent No.: US 8,028,688 B2
(45) Date of Patent: Oct. 4, 2011

(54) CONCRETE BLOCK SPLITTING AND PITCHING APPARATUS AND METHOD

(75) Inventors: William Howard Karau, Southlake, TX (US); Joerg Marx, Grapevine, TX (US)

(73) Assignee: Pavestone Company, LLC, Dallas, TX (US)

( * ) Notice: Subject to any disclaimer, the term of this patent is extended or adjusted under 35 U.S.C. 154(b) by 0 days.

(21) Appl. No.: 11/583,592

(22) Filed: Oct. 18, 2006

(65) Prior Publication Data

US 2008/0096471 A1 Apr. 24, 2008

(51) Int. Cl.
*B28D 1/26* (2006.01)

(52) U.S. Cl. ..... 125/23.01; 125/40; 225/104

(58) Field of Classification Search ..... 451/41; 125/23.01, 24, 41, 40; 225/94, 96, 96.5, 225/103, 104, 105

See application file for complete search history.

(56) References Cited

U.S. PATENT DOCUMENTS

| | | | | |
|---|---|---|---|---|
| 415,773 | A | 11/1889 | Fiske | |
| 470,788 | A * | 3/1892 | Lachapelle et al. | 125/40 |
| 511,098 | A | 12/1893 | Shultz | |
| 534,462 | A | 2/1895 | Balsley | |
| 787,199 | A | 4/1905 | Lloyd | |
| 803,014 | A | 10/1905 | McIlravy | |
| 806,951 | A | 12/1905 | Bryning | |
| 1,086,975 | A | 2/1914 | Aaronson | |
| 1,092,621 | A | 4/1914 | Worner | |
| 1,272,533 | A * | 7/1918 | Robinson | 425/385 |
| 1,287,055 | A | 12/1918 | Lehman | |
| 1,534,353 | A | 4/1925 | Besser | |
| 1,872,522 | A | 8/1932 | Stuckey | |
| 1,893,430 | A | 1/1933 | McKenzie | |
| 2,203,935 | A | 6/1940 | Hedlund | |
| 2,219,606 | A | 10/1940 | Schoick | |
| 2,313,363 | A | 3/1943 | Schmitt | |
| 2,319,154 | A * | 5/1943 | Orlow | 125/23.01 |
| 2,593,606 | A | 4/1952 | Price | |
| 2,657,681 | A | 11/1953 | Gatzke | |
| 2,746,447 | A | 5/1956 | Petch | |
| 2,775,326 | A | 12/1956 | Blum | |
| 2,867,205 | A | 1/1959 | Vesper | |

(Continued)

FOREIGN PATENT DOCUMENTS

GB 924290 4/1963

(Continued)

OTHER PUBLICATIONS

"Haith Robot System for Aggregate Industries," http://www.hub-4.com/news/109/haith-robot-system-for-aggregate-industries, Jul. 31, 2006.

(Continued)

*Primary Examiner* — Timothy V Eley

(74) *Attorney, Agent, or Firm* — Jackson Walker L.L.P.; Christopher J. Rourk

(57) ABSTRACT

An apparatus for splitting a concrete block and pitching at least one edge of the split concrete block is provided. The apparatus includes a splitting blade have a blade edge, such as a sharpened edge or a dull edge. The splitting blade is configured to move in a first direction so as to split a concrete block into two or more sections. The apparatus also includes a pitching blade having a blade edge, such as a sharpened and adjacent to the splitting blade, the pitching blade edge vertically offset from the splitting blade edge so as to pitch an edge of one of the sections of the concrete block after the concrete block has been split.

20 Claims, 7 Drawing Sheets

U.S. PATENT DOCUMENTS 2,881,753 A * 4/1959 Entz ..... 125/23.01
2,925,080 A 2/1960 Smith
3,095,868 A 7/1963 Mangis
3,120,842 A 2/1964 Cox et al.
3,392,719 A 7/1968 Clanton et al.
3,425,105 A 2/1969 Guide
3,492,984 A 2/1970 Harper
3,559,631 A 2/1971 Mangis
3,677,258 A * 7/1972 Fletcher et al. ..... 125/23.01
3,809,049 A * 5/1974 Fletcher et al. ..... 125/23.01
3,940,229 A 2/1976 Hutton
3,981,953 A 9/1976 Haines
4,023,767 A 5/1977 Fontana
4,050,864 A 9/1977 Komaki
4,098,865 A 7/1978 Repasky
4,114,773 A 9/1978 Sekiguchi
4,139,593 A 2/1979 Holz et al.
4,178,340 A 12/1979 Hyytinen
4,193,718 A 3/1980 Wahrendorf et al.
4,250,863 A 2/1981 Gagnon et al.
4,335,549 A 6/1982 Dean, Jr.
4,391,312 A * 7/1983 Sakraida, Jr. ..... 144/195.8
4,524,551 A 6/1985 Scheiwiller
4,599,929 A * 7/1986 Dutina ..... 83/821
4,627,764 A 12/1986 Scheiwiller
4,770,218 A 9/1988 Duerr
4,782,866 A * 11/1988 Valdez ..... 144/195.8
4,784,821 A 11/1988 Leopold
D299,067 S 12/1988 Forsberg
4,802,836 A 2/1989 Whissell
4,834,155 A * 5/1989 Vuollet ..... 144/176
4,848,309 A 7/1989 Alderete
4,869,660 A 9/1989 Ruckstuhl
4,973,192 A 11/1990 Hair
D315,026 S 2/1991 Castonguay et al.
5,017,049 A 5/1991 Sievert
5,028,172 A 7/1991 Wilson et al.
5,031,376 A 7/1991 Bender et al.
5,056,998 A 10/1991 Goossens
5,066,070 A 11/1991 Clarke
5,078,940 A 1/1992 Sayles
5,107,911 A * 4/1992 Plakotaris ..... 144/193.1
5,139,006 A * 8/1992 Trudeau ..... 125/12
5,152,275 A 10/1992 Landhuis
5,158,132 A 10/1992 Guillemot
5,217,630 A 6/1993 Sayles
5,413,086 A * 5/1995 Trudeau ..... 125/23.01
5,441,092 A * 8/1995 Randle ..... 144/378
5,487,526 A 1/1996 Hupp
5,534,214 A 7/1996 Sakamoto et al.
D377,181 S 1/1997 Hupp
D378,702 S 4/1997 Blomquist et al.
5,662,094 A 9/1997 Giacomelli
5,662,386 A 9/1997 Newman et al.
5,687,515 A 11/1997 Rodrigues et al.
5,709,062 A 1/1998 Woolford
5,722,386 A 3/1998 Fladgard et al.
5,733,470 A 3/1998 Roth et al.
5,735,643 A 4/1998 Castonguay et al.
5,762,061 A 6/1998 Bevan
5,788,423 A 8/1998 Perkins
5,791,389 A * 8/1998 Valdez ..... 144/366
5,827,015 A 10/1998 Woolford et al.
D404,146 S 1/1999 Perkins
5,879,603 A 3/1999 Sievert
5,884,445 A 3/1999 Woolford
6,029,943 A 2/2000 Sievert
6,050,255 A 4/2000 Sievert
6,082,057 A 7/2000 Sievert
6,102,026 A 8/2000 Fladgard et al.
6,113,379 A 9/2000 LaCroix et al.
6,138,983 A 10/2000 Sievert
6,142,713 A 11/2000 Woolford et al.
6,149,352 A 11/2000 MacDonald
6,178,704 B1 1/2001 Sievert
D438,640 S 3/2001 Bolles
6,199,545 B1 * 3/2001 Adamson ..... 125/41
6,209,848 B1 4/2001 Bolles et al.
D442,703 S 5/2001 Fifield
6,224,815 B1 5/2001 LaCroix et al.
D448,861 S 10/2001 Daniels et al.
6,321,740 B1 11/2001 Scherer et al.
6,401,707 B1 6/2002 Fladgard et al.
D464,145 S 10/2002 Scherer
6,460,534 B1 10/2002 Vasquez et al.
6,464,199 B1 10/2002 Johnson
6,502,569 B1 1/2003 Lee
6,609,545 B1 * 8/2003 Gelder ..... 144/195.8
6,668,816 B1 12/2003 Pedersen et al.
6,705,190 B2 * 3/2004 Newnes et al. ..... 83/75.5
6,874,494 B2 4/2005 Scherer et al.
D505,733 S 5/2005 Castonguay et al.
6,886,551 B2 * 5/2005 Scherer et al. ..... 125/23.01
6,910,474 B1 6/2005 Scherer
6,918,715 B2 * 7/2005 Scherer et al. ..... 405/284
6,964,272 B2 * 11/2005 Scherer ..... 125/23.01
7,055,517 B1 6/2006 Kitahara
7,066,167 B2 * 6/2006 Scherer et al. ..... 125/23.01
7,077,121 B1 * 7/2006 Havill ..... 125/23.01
5,827,015 C1 8/2006 Woolford et al.
6,142,713 C1 8/2006 Woolford et al.
7,104,295 B2 * 9/2006 Heikkinen et al. ..... 144/193.1
7,252,081 B2 * 8/2007 Havill ..... 125/23.01
7,428,900 B2 * 9/2008 Scherer ..... 125/23.01
2002/0015620 A1 2/2002 Woolford et al.
2002/0092257 A1 7/2002 Scherer et al.
2003/0180099 A1 9/2003 Scherer et al.
2005/0268901 A1 * 12/2005 Scherer ..... 125/23.01
2006/0054154 A1 3/2006 Scherer

FOREIGN PATENT DOCUMENTS

GB 948121 1/1964
GB 1 509 747 5/1978

OTHER PUBLICATIONS

"Reconstructed Stone—Stone Pitchers," http://www.haithindustrialco.uk/index.php?sec=cont&id=26, Jul. 31, 2006.
"Natural Stone—Block and Slab Splitting," http://www.haithindustrial.co.uk/index.php?sec=cont&id=32, Jul. 31, 2006.
"Splitting, Cutting, Marking & Layout," http://www.pavetech.com/newtools/cutting.shtm, Jul. 31, 2006.
"Stone Splitter," http://www.pavetech.com/newtools/stonesplitter.shtm, Jul. 31, 2006.
"Splitters/Turnovers," http://www.besser.com/equipment/splitters/, Aug. 3, 2006.
"Split-Face Concrete Block," http://www.toolbase.org/Technology-Inventory/walls/split-face-concrete-block, Aug. 3, 2006.

* cited by examiner

CONCRETE BLOCK SPLITTING AND PITCHING APPARATUS AND METHOD

RELATED APPLICATIONS

This application is related to U.S. patent application Ser. No. 11/583,194, filed Oct. 18, 2006, entitled "CONCRETE BLOCK SPLITTING AND PITCHING APPARATUS AND METHOD," and U.S. patent application Ser. No. 11/583,192, filed Oct. 18, 2006, entitled "MASONRY BLOCK MULTI-SPLITTING APPARATUS AND METHOD," commonly owned, and incorporated by reference for all purposes.

FIELD OF THE INVENTION

The present invention pertains to the field of concrete block manufacturing, and more specifically to a concrete block splitting and pitching apparatus and method for splitting a concrete block into two or more sections and pitching the edges of the sections in a single step.

BACKGROUND OF THE INVENTION

Prior art systems and methods for manufacturing concrete blocks have included splitting devices that use two or more diametrically-opposed blades in a press, where the blades cause the concrete block to split into two parts. Some of the prior art concrete block splitters further include ridges or projections to create random variations on the concrete block, so as to manufacture a plurality of blocks that do not appear to be identical, to simulate a hand-made or naturally-occurring block.

In addition, prior art systems and methods have included pitching devices that pitch the edges of a concrete block. These pitching devices are also used to create random variations to simulate hand-made or naturally-occurring block. As such, the prior art concrete block manufacturing systems and methods teach away from creation of features on a concrete block in a controlled manner.

SUMMARY OF THE INVENTION

In accordance with the present invention, a concrete block splitting and pitching apparatus and method are provided that allow a concrete block to be split and pitched in a single step.

In particular, a system and method for splitting and pitching a concrete block are provided that allow the pitching of the concrete block to be controlled so as to create controlled features on the pitched surface.

In accordance with an exemplary embodiment of the present invention, an apparatus for splitting a concrete block and pitching at least one edge of the split concrete block is provided. The apparatus includes a splitting blade have a blade edge, such as a sharpened edge or a dull edge. The splitting blade is configured to move in a first direction so as to split a concrete block into two or more sections. The apparatus also includes a pitching blade having a blade edge, such as a sharpened and adjacent to the splitting blade, the pitching blade edge vertically offset from the splitting blade edge so as to pitch an edge of one of the sections of the concrete block after the concrete block has been split.

The present invention provides many important technical advantages. One important technical advantage of the present invention is an apparatus and method for splitting and pitching a concrete block that allows the concrete block to be split and pitched in a single step, so as to create a pitched surface having reduced random variations.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
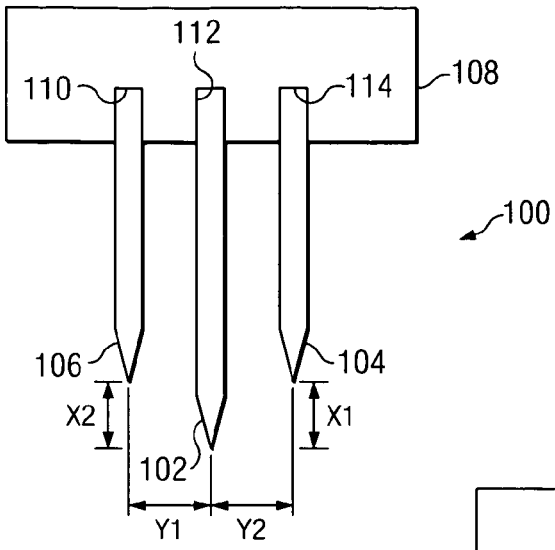
FIG. 1 is a diagram of an edge view of a blade assembly in accordance with an exemplary embodiment of the present invention.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of an edge view of a blade assembly 100 in accordance with an exemplary embodiment of the present invention. Blade assembly 100 allows a block, such as one formed from concrete, masonry, or other suitable materials (all hereinafter referred to in general as a concrete block) to be split and pitched in a single step, as opposed to requiring multiple steps and stations for splitting and pitching.

Blade assembly 100 includes splitting blade 102 and pitching blades 104 and 106. Each of splitting blade 102 and pitching blades 104 and 106 are secured in grooves 112, 114 and 110, respectively, of blade holder 108, which can be an interchangeable blade holder assembly, a static blade holder assembly that is part of a larger cutting machine, or other suitable blade assemblies. In one exemplary embodiment, pins, screws, clamps, or other suitable devices or materials can be used to secure splitting blade 102 in groove 112 and pitching blades 104 and 106 in grooves 114 and 110, respectively. The shape of splitting blade 102 and pitching blades 104 and 106 can likewise be altered, such as to interlock with grooves 112, 114 and 116, respectively, or for other suitable purposes.

Splitting blade 102 and pitching blades 104 and 106 are made from suitable material for splitting concrete blocks, such as steel or other suitable blade material. Pitching blades 104 and 106 are inset a distance "X1" and "X2," respectively, from splitting blade 102, such that when blade holder 108 is moved towards the concrete block to be split and pitched, splitting blade 102 encounters the concrete block first and causes the block to split. Pitching blades 104 and 106 then encounter the block after it has been split so as to cause the split edge of the block to be pitched. Furthermore, splitting blade 102 can be used to affect the action of pitching blades 104 and 106, such as by increasing the height difference "X1" and "X2" so that splitting blade 102 applies a force against the split face of the concrete block. In this exemplary embodiment, the spacings "X1," "X2," "Y1" and "Y2" as shown can be varied as suitable to create different pitch depths, spacing, to decrease the amount of force required to perform the pitching and splitting operations, to control the quality of the pitching and splitting operations so as to reduce random variations in the split or pitched surfaces, or for other suitable purposes.

Splitting blade 102 and pitching blades 104 and 106 can be removed to allow them to be replaced, such as to modify the height difference "X1" or "X2," the spacing "Y1" or "Y2," to replaced blades after they have been damaged or worn, or for other suitable purposes. Further variations of exemplary pitching blades 104 and 106 are shown in side view in FIGS. 2, 5, 6 from the view as shown in FIG. 1.

In operation, blade assembly 100 is used in conjunction with other blade assemblies to split a concrete block and to pitch the resulting edges in a single combined splitting and pitching operation. The separation "Y1" and "Y2" between the plane of splitting blade 102 and the planes of pitching blades 104 and 106, respectively, and "X1" and "X2" between the edge of splitting blade 102 and between the edge of pitching blades 104 and 106, respectively, can be varied to control the quality of the pitched edge that is formed after splitting. In one exemplary embodiment, the width of splitting blade 102 can be controlled so as to separate the segments of the split concrete block so as to prevent interference between the segments as they are split, which can create random variations that might not be desired. Other suitable variations described herein can also or alternatively be used to control the pitching of edges after splitting.

Figure 2:
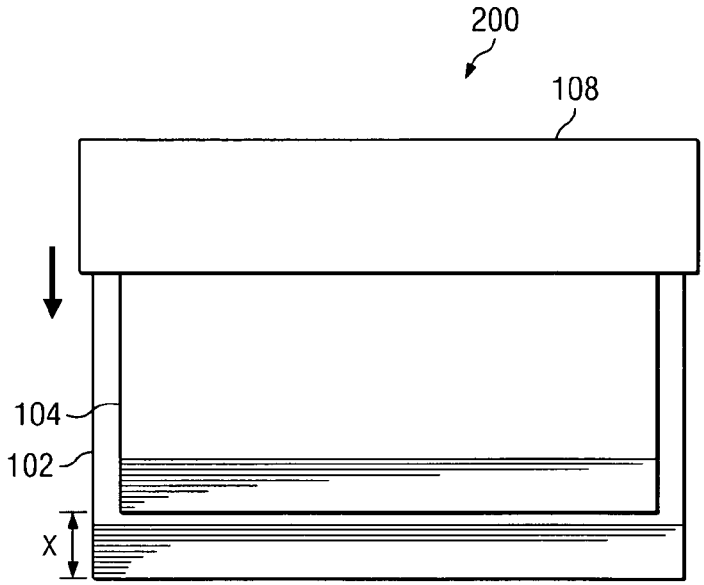
FIG. 2 is a diagram of a side view of a blade assembly in accordance with an exemplary embodiment of the present invention.

FIG. 2 is a diagram of a side view of blade assembly 200 in accordance with an exemplary embodiment of the present invention. Blade assembly 200 includes splitting blade 102 and pitching blade 104. Splitting blade 102 and pitching blade 104 are held by blade holder 108. In addition, the offset "X1" between splitting blade 102 and pitching blade 104 is shown in FIG. 2.

In operation, blade assembly 200 is moved towards a concrete block in the direction of the arrow to split the concrete block and to pitch the edges of the concrete block in a single step. In one exemplary embodiment, blade assembly 200 can be part of a hydraulic, pneumatic, electric or mechanical press that simultaneously moves blade assembly 200 down onto the concrete block to be split, two other blade assemblies sideways against the concrete block, and one additional blade assembly upwards against the concrete block. When blade assembly 200 is used for each blade assembly, each edge of the two block pieces that are formed from the concrete block that is being split can be pitched. The pitched surface created using blade assembly 200 can be controlled to have predetermined characteristics based on the orientation of splitting blade 102 and pitching blade 104, such as by increasing the planar separation "Y2" or the edge height separation "X1" as shown in FIG. 1.

Figure 3:
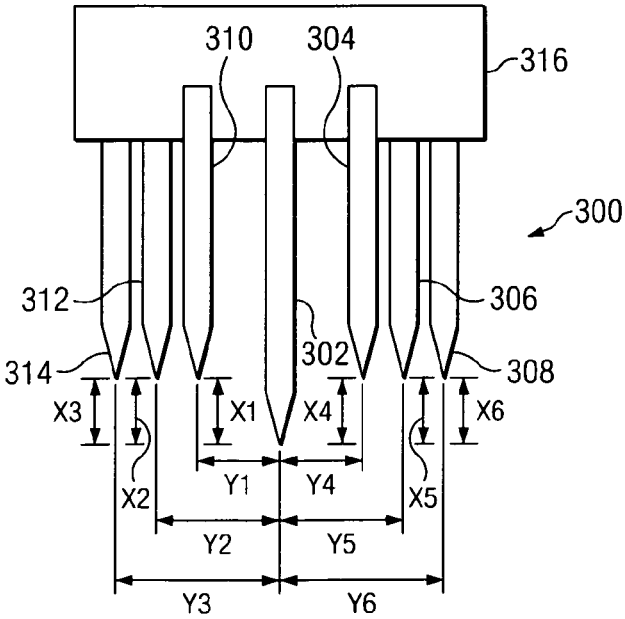
FIG. 3 is a diagram of an edge view of a blade assembly with parallel staggered blades in accordance with an exemplary embodiment of the present invention.

FIG. 3 is a diagram of an edge view of blade assembly 300 with parallel staggered blades in accordance with an exemplary embodiment of the present invention. Blade assembly 300 includes splitting blade 302 and pitching blades 304, 306, 308 and 310, 312, and 314. Each of the splitting and pitching blades are held by blade holder 316 in corresponding slots. As shown, pitching blades 304, 306, 308 and pitching blades 310, 312, and 314 are parallel to and staggered from each other so as to create a staggered pitching effect. A side view of the arrangement of splitting blade 302 and pitching blades 304, 306, and 308 is shown in FIG. 4.

In addition, pitching blades 304, 306, 308 and pitching blades 310, 312, and 314 are separated from splitting blade 302 by a distance of Y4, Y5, Y6, Y1, Y2 and Y3, respectively, and the cutting edge of pitching blades 304, 306, 308 and pitching blades 310, 312, and 314 are separated from the cutting edge of splitting blade 302 by a distance of X4, X5, X6, X1, X2 and X3, respectively. In this manner, the separation between the pitching blades and the splitting blade can be controlled so as to reduce the amount of force required to split and pitch the concrete block, to control the pitching of the concrete block edges after splitting so as to eliminate unwanted random variations, and for other suitable purposes.

Figure 4:
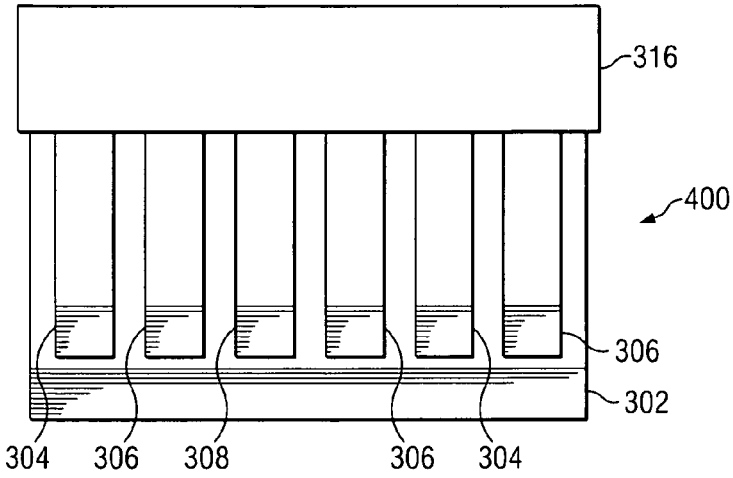
FIG. 4 is a diagram of a side view of a blade assembly with parallel and axially staggered blades in accordance with an exemplary embodiment of the present invention.

FIG. 4 is a diagram of a side view of blade assembly 400 with parallel and axially staggered blades in accordance with an exemplary embodiment of the present invention. Blade assembly 400 includes splitting blade 302 and pitching blades 304, 306 and 308, each of which is held by blade holder 316. As shown in FIG. 3, pitching blade 304 is parallel to and axially offset from splitting blade 302 by a different amount than the axial offset of pitching blades 306 and 308, which are also parallel to splitting blade 302. In this manner, an axially-scalloped pitching effect can be created on each block that is split and pitched using blade assembly 400.

Figure 5:
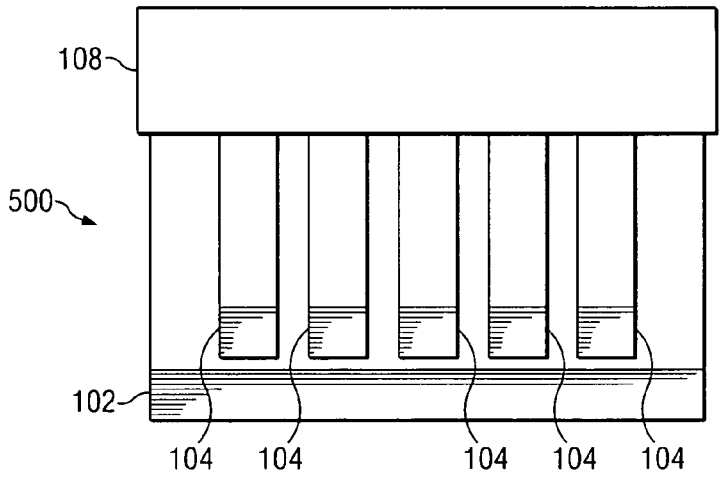
FIG. 5 is a diagram of a side view of a blade assembly with aligned parallel blades in accordance with an exemplary embodiment of the present invention.

FIG. 5 is a diagram of a side view of blade assembly 500 with aligned parallel blades in accordance with an exemplary embodiment of the present invention. Blade assembly 500 includes splitting blade 102, pitching blades 104, and blade holder 108. Unlike blade assembly 400, which has a plurality of pitching blades that are axially staggered, the pitching blades of blade assembly 500 are not axially offset but lie alongside the same horizontal axis. In this manner, the pitching cuts made by pitching blades 104 do not form an axially-scalloped pitching effect, and the scalloped pitching effect created by blade assembly 500 might result in some random variations that cause concrete blocks created using blade assembly 500 to contain certain desired random variations while retaining a scalloped effect.

Figure 6:
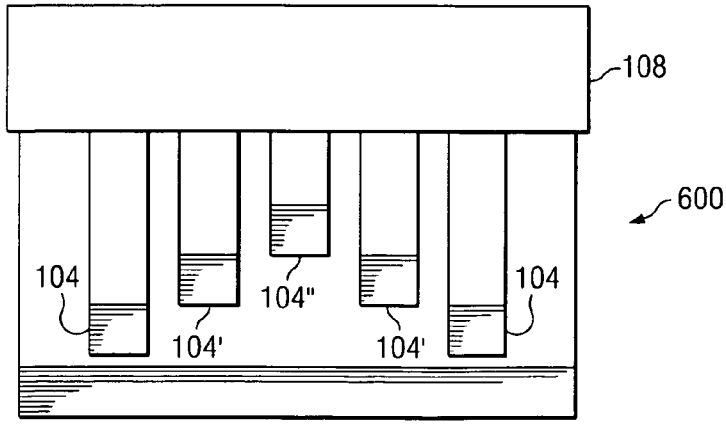
FIG. 6 is a diagram of a blade assembly with vertically staggered blades in accordance with an exemplary embodiment of the present invention.

FIG. 6 is a diagram of blade assembly 600 with vertically staggered blades in accordance with an exemplary embodiment of the present invention. Blade assembly 600 includes splitting blade 102 and pitching blades 104, 104' and 104", each of which are held by blade holder 108. Although the edge view of FIG. 1 necessarily obscures the vertical variations in the height of blades 104, 104' and 104", FIG. 6 shows these vertical variations, which can be used to create a controlled and axially-aligned scalloped pitching effect on the edges of a concrete block after it has been split by splitting blade 102 of blade assembly 600. Likewise, by vertically staggering the height of pitching blades 104, 104' and 104", the amount of force required to split and pitch the concrete block can be decreased, such as where it is desirable to reduce the amount of force that is required to split and pitch concrete blocks in order to meet machine press design loading, to conserve power, or for other suitable purposes.

Figure 7:
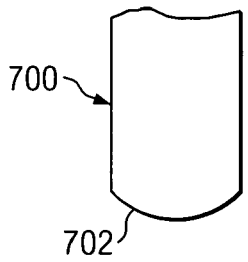
FIG. 7 is a diagram of a pitching blade with a crown in accordance with an exemplary embodiment of the present invention.

FIG. 7 is a diagram of pitching blade 700 with a crown in accordance with an exemplary embodiment of the present invention. Pitching blade 700 includes crown 702 that rises to a peak in the center of pitching blade 700. In this manner, the force required to pitch the block being operated on is decreased by focusing the force at the maximum height of crown 702. Pitching blade 700 also helps to reduce random variations that can result from a flat pitching blade, where the pitching action can start unevenly at various points along the length of the flat pitching blade.

Figure 8:
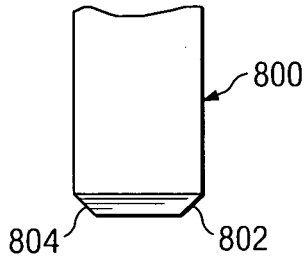
FIG. 8 is a diagram of a pitching blade with cornered edges in accordance with an exemplary embodiment of the present invention.

FIG. 8 is a diagram of pitching blade 800 with cornered edges in accordance with an exemplary embodiment of the present invention. Pitching blade 800 includes cornered edges 802 and 804. In this exemplary embodiment, providing a corner on cornered edges 802 and 804 can help to prevent cracking or other unintended effects on the concrete block section that has been split, which can create random variations in the appearance of the pitched surface.

Figure 9:
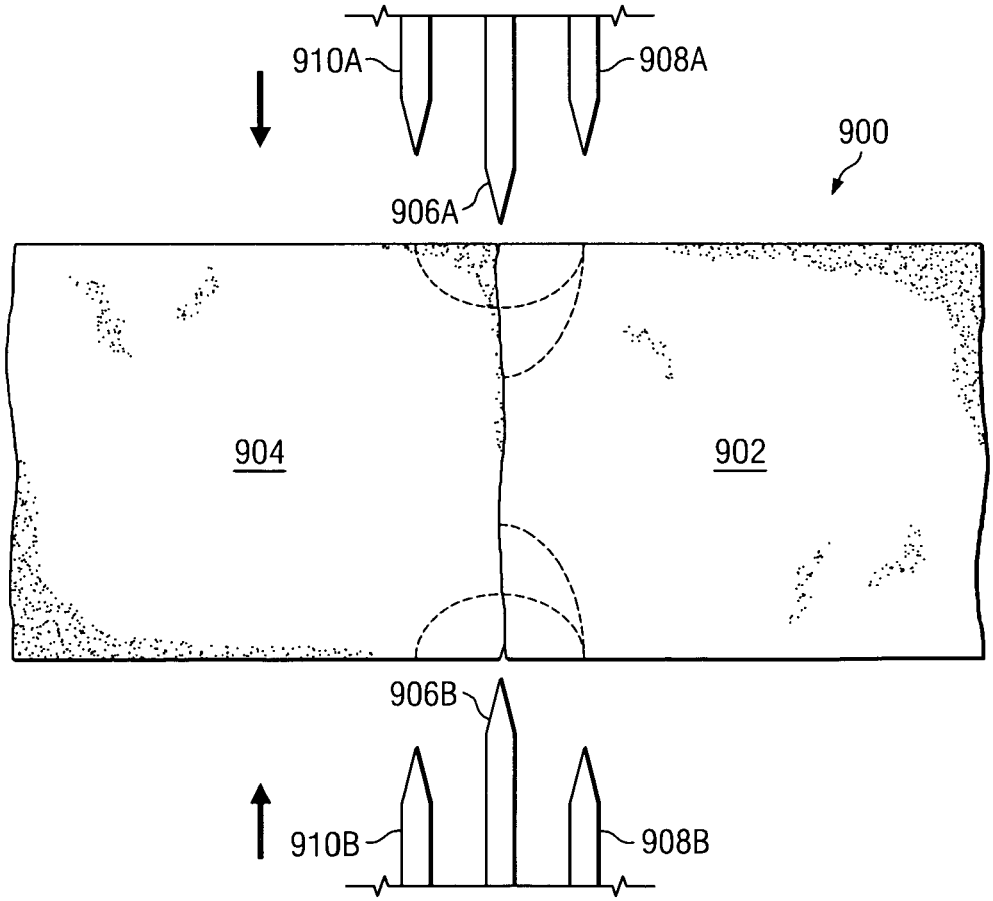
FIG. 9 is a diagram of a concrete block in accordance with an exemplary embodiment of the present invention.

FIG. 9 is a diagram of concrete block 900 in accordance with an exemplary embodiment of the present invention. Concrete block 900 is shown being split into two sections, 902 and 904. Splitting blades 906A and 906B are used to split concrete block 900 into sections 902 and 904 by impacting with the block before pitching blades 908A, 908B, 910A and 910B. Afterwards, pitching blades 908A and 908B on one side of the split and pitching blades 910A and 910B on the opposite side of the split interact with the block so as to pitch the edges of sections 902 and 904 at the split, shown as pitch break in FIG. 9. Two additional sets of splitting and pitching blades can also be used that move perpendicular to the direction of motion shown in FIG. 9. In this manner, a split concrete block having a pitched edge can be created in a single step.

As previously discussed, the spacing of splitting blades 906A and 906B relative to pitching blades 908A, 908B, 910A and 910B can also be varied so as to control the location of the pitch break. For example, if the difference in height between the splitting blades and the pitching blades is sufficient, the splitting blades will provide an axial force to the split face of each concrete block section that will cause the pitch break to elongate as shown. Even a slight difference in height between the splitting blades and the pitching blades will affect the dimensions of the pitch break, making the dimensions more controlled due only to the presence of pitching blades adjacent to the splitting blades and the presence of the newly-split concrete block sections adjacent to each other. In this manner, the dimensions of the pitch break are controlled not only by the pitching blades but also by the configuration of all of the blades in the blade assembly as well as the combined splitting and pitching operation that leaves the split concrete block sections adjacent to each other during the pitching operation.

Figure 10:
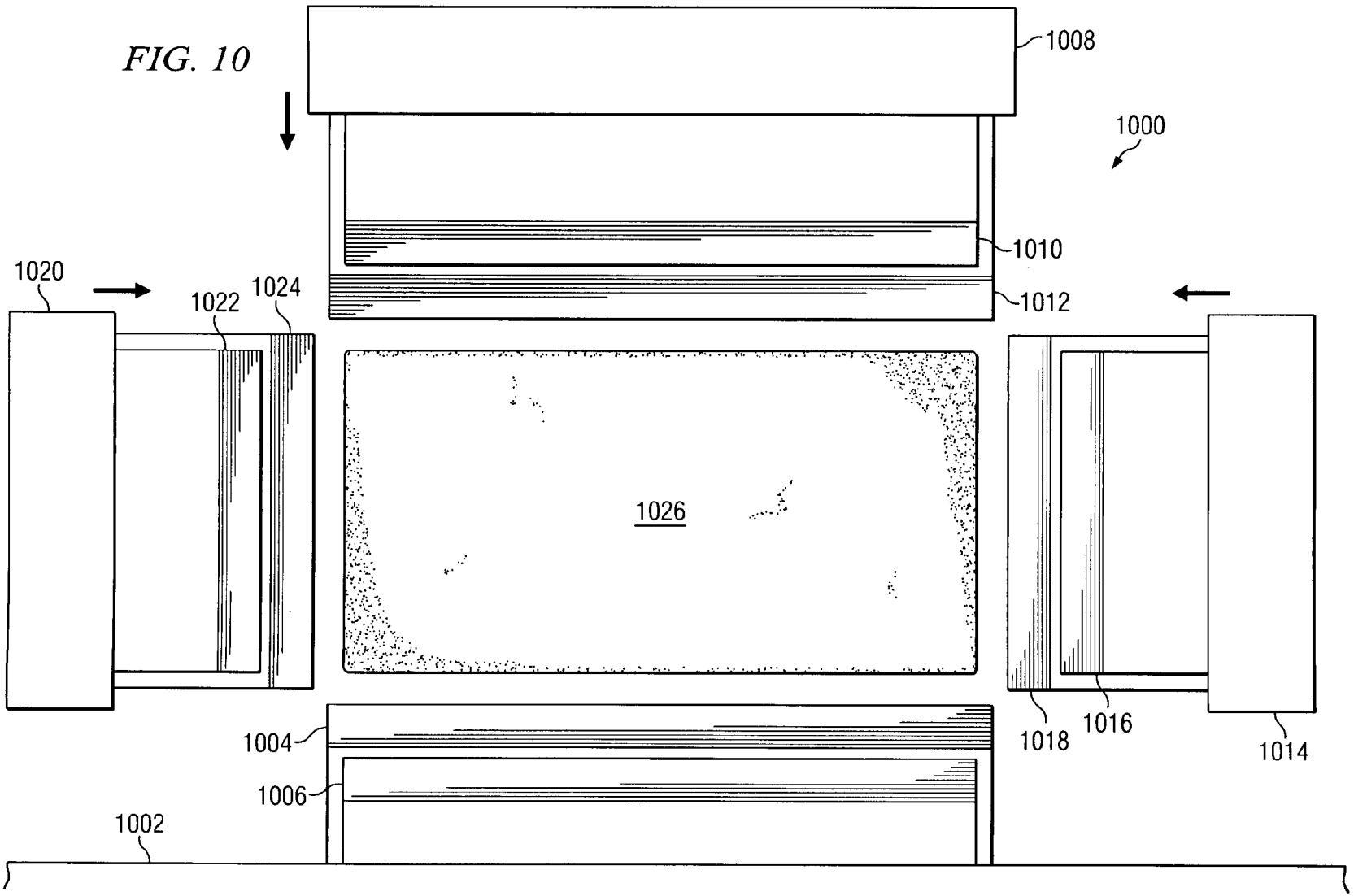
FIG. 10 is a diagram of a press in accordance with an exemplary embodiment of the present invention.

FIG. 10 is a diagram of press 1000 in accordance with an exemplary embodiment of the present invention. Press 1000 includes base 1002 which contains splitting blade 1004 and pitching blade 1006. Likewise, blade holder 1008 holds a corresponding splitting blade 1012 and pitching blade 1010. For splitting the block from the side and pitching the edges on the side, blade holder 1014 holds pitching blade 1016 and splitting blade 1018 and blade holder 1020 holds pitching blade 1022 and splitting blade 1024. Instead of the splitting and pitching blade configurations shown in FIG. 9, other suitable blade configurations, such as those shown herein or other suitable variations described herein, can also or alternatively be used.

In operation, blade holder 1008 is moved downwards, such as by a pneumatic press or other suitable presses capable of providing sufficient force to split concrete block 1026. Likewise, base 1002 can be recessed so as to hold concrete block 1026 up and can include movable splitting blade 1004 and pitching blade 1006 that can be raised, such as by a pneumatic press, in coordination with splitting blade 1012 and pitching blade 1010. In this manner, splitting blades 1012 and 1004 interact with concrete block 1026 so as to create a split through concrete block 1026.

Likewise, blade holders 1014 and 1020 are moved laterally so as to cause splitting blades 1018 and 1024 to interact with concrete block 1026 at the same time that splitting blades 1012 and 1004 interact with concrete block 1026 so to form a uniform split through concrete block 1026. After concrete block 1026 has been split by splitting blades 1004, 1012, 1018 and 1024, pitching blades 1006, 1010, 1016, and 1022 interact with concrete block 1026 so as to pitch the edges of concrete block 1026 along the split. In this manner, concrete block 1026 can be split into two blocks and the edges of each block can be pitched in a single action.

Figure 11:
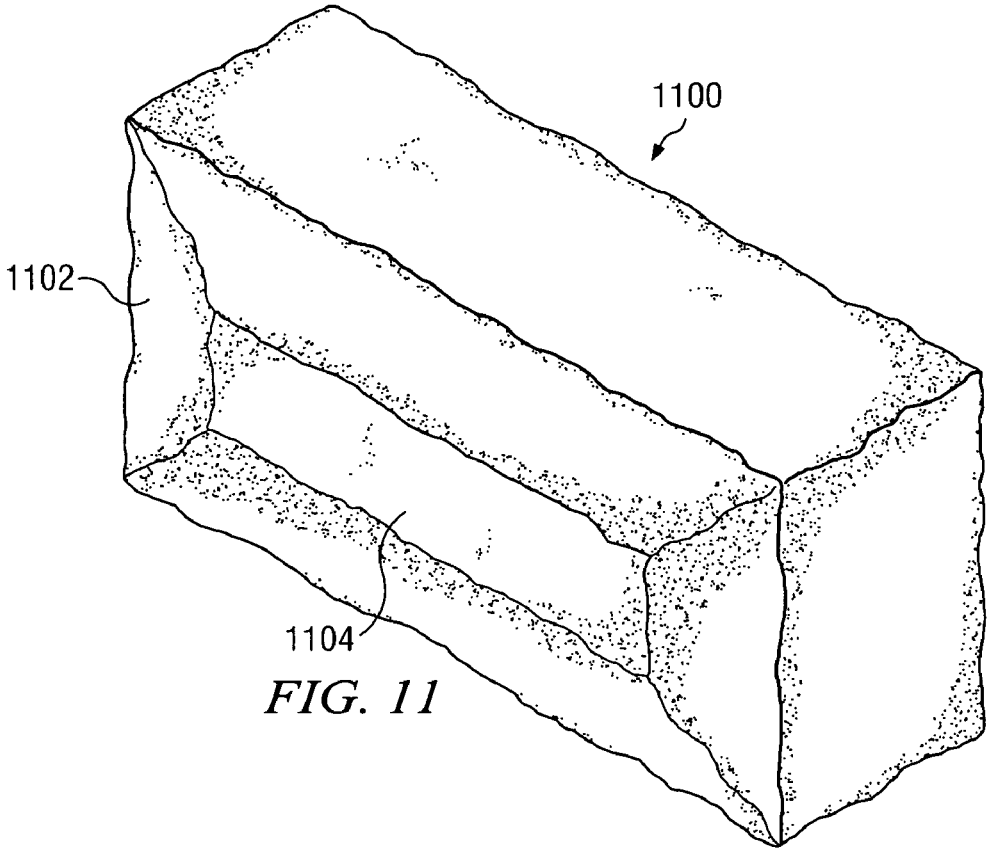
FIG. 11 is a diagram of a concrete block in accordance with an exemplary embodiment of the present invention.

FIG. 11 is a diagram of concrete block 1100 in accordance with an exemplary embodiment of the present invention. Concrete block 1100 includes pitched area 1102 and split face 1104. Pitched area 1102 is formed by pitching blades that are uniform along the length and sides of the splitting assembly. Split face 1104 is formed by splitting blades that are diametrically opposed to each other.

Figure 12:
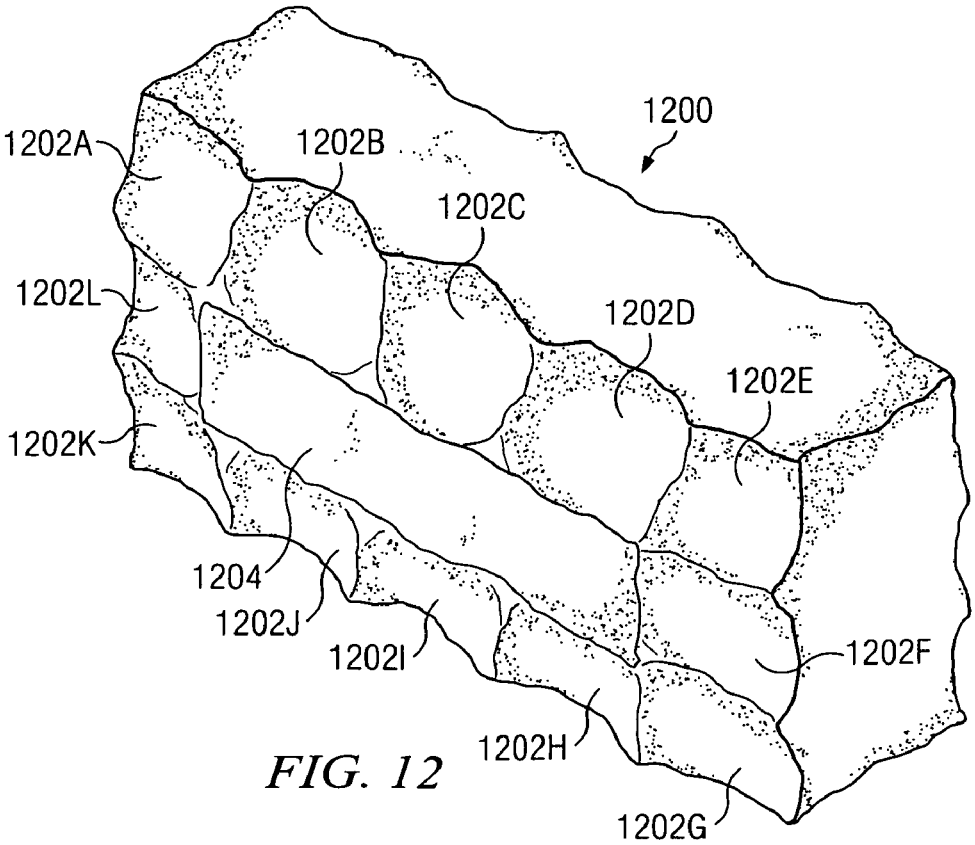
FIG. 12 is a diagram of a concrete block in accordance with an exemplary embodiment of the present invention.

FIG. 12 is a diagram of concrete block 1200 in accordance with an exemplary embodiment of the present invention. Concrete block 1200 includes scalloped sections 1202A through 1202L and split face 1204. As discussed previously, multiple pitching blades can be used to form scalloped sections 1202A through 1202L. By using pitching blades that are offset axially, scalloped sections 1202A through 1202L can be overlapped, or by aligning them and staggering the action of pitching blades by having different pitching blade heights, the scalloped sections can also be overlapped, uniform or can have other desired configurations.

Figure 13:
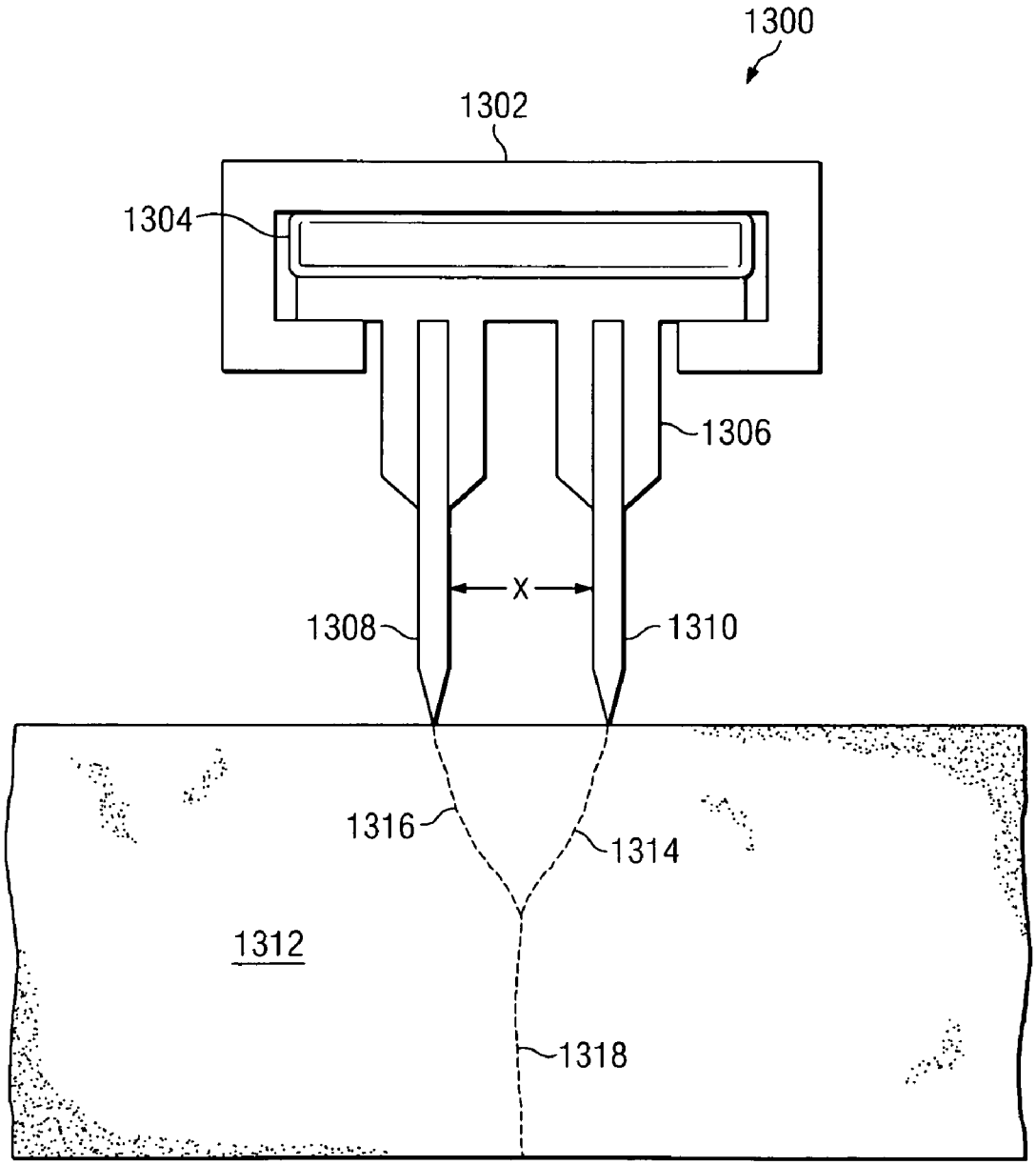
FIG. 13 is a diagram of a pitching blade assembly in accordance with an exemplary embodiment of the present invention.
Figure 14:
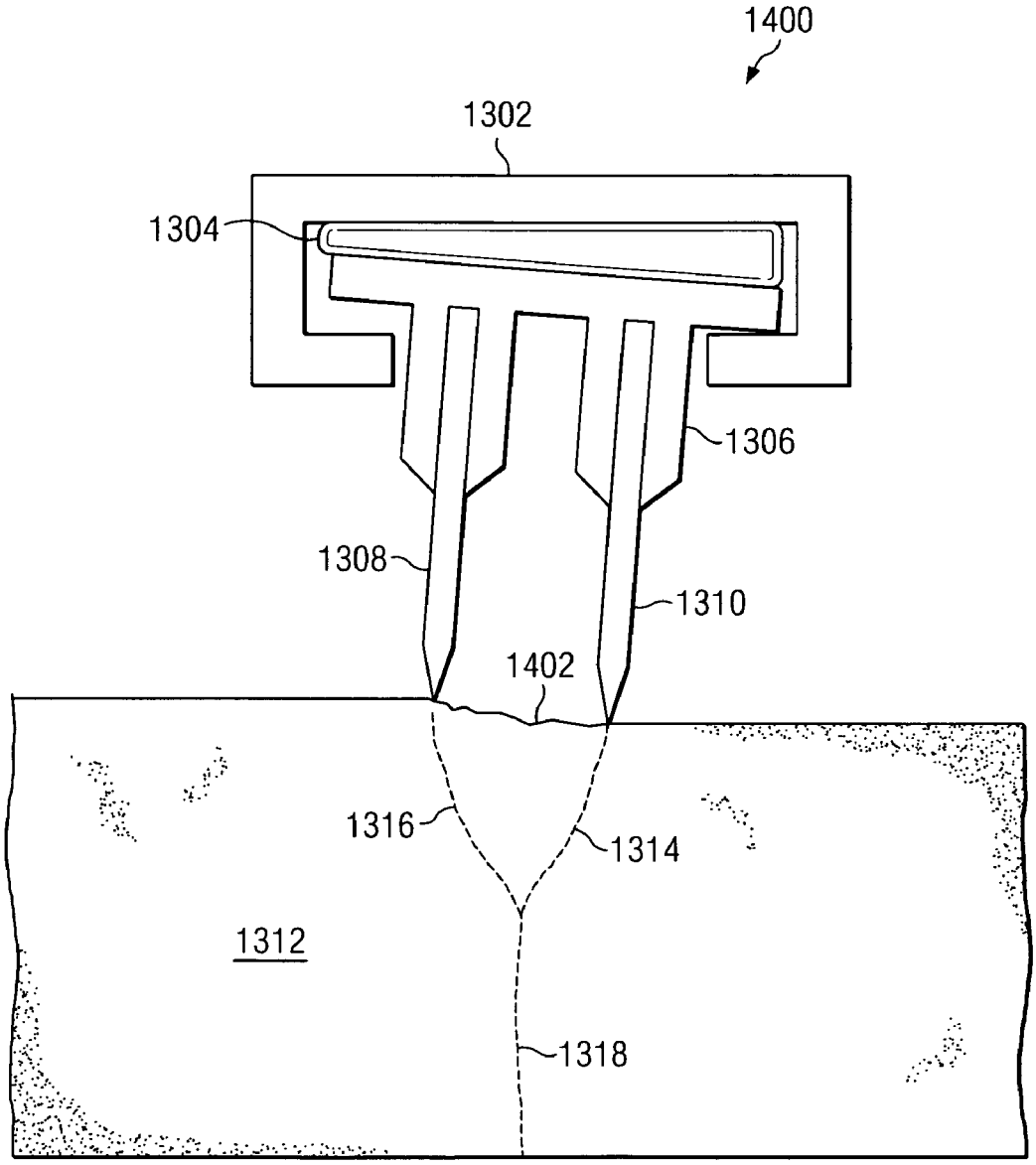
FIG. 14 is a diagram of a pitching blade assembly adjusting to a surface irregularity in accordance with an exemplary embodiment of the present invention.

FIG. 13 is a diagram of a pitching blade assembly 1300 in accordance with an exemplary embodiment of the present invention. Pitching blade assembly 1300 includes press 1302, compressible material 1304 and blade holder assembly 1306. Blade holder assembly 1306 includes two pitching blades 1308 and 1310, separated by a distance "X." If the distance "X" is less than the distance beyond which pitching blades 1308 and 1310 will operate as separate splitting blades, then pitch breaks 1314 and 1316 will form in concrete block 1312, and will propagate together to form split break 1318. The maximum separation distance will be a function of the material characteristics and dimensions of FIG. 14 is a diagram of a pitching blade assembly 1400 adjusting to a surface irregularity in accordance with an exemplary embodiment of the present invention. As shown, concrete block 1312 includes surface irregularity 1402, which causes pitching blades 1308 and 1310 to conform to the surface of concrete block 1312. Compressible material 1304 allows blade holder assembly 1306 to shift, so as to allow pitching blades 1308 and 1310 to conform to surface irregularity 1402 of concrete block 1312, which avoids improper propagation of pitch breaks 1314 and 1316.

Although exemplary embodiments of a system and method of the present invention have been described in detail herein, those skilled in the art will also recognize that various substitutions and modifications can be made to the systems and methods without departing from the scope and spirit of the appended claims.

What is claimed is:

1. An apparatus for splitting a concrete block and pitching at least one edge of the split concrete block comprising:

a splitting blade having a blade edge and configured to move in a first direction so as to split a concrete block into two or more sections; and a pitching blade having a blade edge and located parallel and adjacent to the splitting blade, the pitching blade edge vertically offset from the splitting blade edge so as to pitch an edge of one of the sections of the concrete block after the concrete block has been split while moving in the first direction.

2. The apparatus of claim 1 wherein the pitching blade comprises a plurality of axially-adjacent pitching blades.

3. The apparatus of claim 1 wherein the pitching blade comprises a plurality of axially-staggered pitching blades.

4. The apparatus of claim 1 wherein the pitching blade comprises a plurality of vertically-adjacent pitching blades.

5. The apparatus of claim 1 wherein the pitching blade comprises a plurality of vertically-staggered pitching blades.

6. The apparatus of claim 1 further comprising a second pitching blade having a blade edge and adjacent to the splitting blade, the pitching blade edge vertically offset from the splitting blade edge so as to pitch an edge of another of the sections of the concrete block after the concrete block has been split.

7. The apparatus of claim 1 wherein the blade edge of the pitching blade has a crown.

8. A method for splitting and pitching a concrete block comprising:

activating a press in a starting position to move in a first direction;

splitting a concrete block into at least two sections using a splitting blade that is driven by the press;

pitching an edge of one section of the concrete block using a pitching blade that is driven parallel to the splitting blade by the press after the concrete block has been split and while the press moves in the first direction; and returning the press to the starting position after the concrete block has been split and the edge of the concrete block has been pitched.

9. The method of claim 8 further comprising pitching an edge of another section of the concrete block using a second pitching blade that is driven by the press after the concrete block has been split and while the press moves in the first direction.

10. The method of claim 8 wherein pitching the edge of one section of the concrete block using the pitching blade comprises pitching the edge of one section of the concrete block using a plurality of axially-aligned pitching blade sections.

11. The method of claim 8 wherein pitching the edge of one section of the concrete block using the pitching blade comprises pitching the edge of one section of the concrete block using a plurality of axially-staggered pitching blade sections.

12. The method of claim 8 wherein pitching the edge of one section of the concrete block using the pitching blade comprises pitching the edge of one section of the concrete block using a plurality of vertically-aligned pitching blade sections.

13. The method of claim 8 wherein pitching the edge of one section of the concrete block using the pitching blade comprises pitching the edge of one section of the concrete block using a plurality of vertically-staggered pitching blade sections.

14. An apparatus for splitting a concrete block into two sections and pitching at least one edge of each of the concrete block sections comprising:

a splitting blade having a blade edge and configured to move in a first direction so as to split the concrete block into the two or more sections;

a first pitching blade having a blade edge and located parallel and adjacent to one side of the splitting blade, the first pitching blade edge vertically offset from the splitting blade edge so as to pitch an edge of one of the sections of the concrete block after the concrete block has been split while moving in the first direction; and a second pitching blade having a blade edge and located parallel and adjacent to another side of the splitting blade, the second pitching blade edge vertically offset from the splitting blade edge so as to pitch an edge of one of the other sections of the concrete block after the concrete block has been split while moving in the first direction.

15. The apparatus of claim 14 wherein the first pitching blade and the second pitching blade each comprise a plurality of axially-aligned blades.

16. The apparatus of claim 14 wherein the first pitching blade and the second pitching blade each comprise a plurality of axially-staggered blades.

17. The apparatus of claim 14 wherein the first pitching blade and the second pitching blade each comprise a plurality of vertically-aligned blades.

18. The apparatus of claim 14 wherein the first pitching blade and the second pitching blade each comprise a plurality of vertically-staggered blades.

19. The apparatus of claim 14 wherein the first pitching blade comprises a plurality of axially-aligned blades and the second pitching blade comprises a plurality of axially-staggered blades.

20. The apparatus of claim 14 wherein the first pitching blade comprises a plurality of vertically-aligned blades and the second pitching blade comprises a plurality of vertically-staggered blades.

* * * * *